United States Patent [19]

Hicks

[11] 4,245,444

[45] Jan. 20, 1981

[54] SMOOTH FLOOR CONSTRUCTION FOR THE CHAMBER BENEATH CARDING AND SIMILAR TEXTILE MACHINES

[75] Inventor: Harry H. Hicks, Winston-Salem, N.C.

[73] Assignee: Industrial Air, Inc., Greensboro, N.C.

[21] Appl. No.: 32,526

[22] Filed: Apr. 23, 1979

[51] Int. Cl.[3] ..... E04H 14/00; D01G 15/82

[52] U.S. Cl. ..... 52/173 R; 15/301; 15/316 R; 19/107; 52/292; 52/309.1; 52/309.12; 52/309.17; 52/741

[58] Field of Search ..... 19/107; 52/309.1, 309.12, 52/309.17, 27, 292, 294, 173 R, 741; 15/316 R, 301

[56] References Cited

U.S. PATENT DOCUMENTS

| | | | |
|---|---|---|---|
| 2,964,804 | 12/1960 | Schönenberger | 19/107 |
| 3,194,853 | 7/1965 | Weise et al. | 52/294 X |
| 4,005,954 | 2/1977 | Hinsche et al. | 52/515 X |
| 4,057,877 | 11/1977 | Gunter | 19/107 |
| 4,087,888 | 5/1978 | Tanak | 15/301 X |

FOREIGN PATENT DOCUMENTS

| | | | |
|---|---|---|---|
| 2633594 | 2/1978 | Fed. Rep. of Germany | 52/515 |
| 562740 | 7/1944 | United Kingdom | 19/107 |

OTHER PUBLICATIONS

Textile World, Sep. 1963, pp. 53, 54.

Architectural Engineering, vol. 119, No. 4, Apr. 1956, p. 265.

*Primary Examiner*—Alfred C. Perham

[57] ABSTRACT

A grout-like material of a type which is initially liquid is poured or floated into the chamber beneath the cylindrical elements of conventional carding machines, or other textile machines which generate quantities of waste thereunder, to a desired level greater in depth than the largest crack between the carding machine frame and the surface on which it rests, so that the grout fills and covers all the cracks around the bottom of the frame. Upon drying the grout material adheres to the surface on which the card frame rests and the side walls of the frame and essentially seals the area beneath the machine as well as forming a slick surface over which lint and dust may be more easily moved by pneumatic undercard cleaning systems. Such a floor construction eliminates burrs or other areas where tags and lint might accumulate. If desired, the grout may be covered with a slick finish or outer coating, such as a urethane or acrylic type floor coating to provide an even smoother finish. Where carding machines are provided with a cross-girt, the grout material is filled to a level greater in depth than the height of the top of the girt from the surface on which the carding machine rests, so that no hump or obstruction to the flow of lint through the bottom of the machine is present.

7 Claims, 2 Drawing Figures

SMOOTH FLOOR CONSTRUCTION FOR THE CHAMBER BENEATH CARDING AND SIMILAR TEXTILE MACHINES

BACKGROUND OF THE INVENTION

During operation textile machines involved in fiber preparation such as cards generate considerable amounts of dust, fibers, and lint which are emitted at various points on the card as the stock proceeds through the machine. Various lickerin and doffer waste collection plenums or hoods are disclosed in the prior art which are mounted on the upper portions of the machine and connected to suction ducts leading to filtration systems, and are generally adequate to capture most of the dust and fibers emitted upwardly from the upper portions of the card machine.

Cleaning of the undercard chamber or cavity has been a more difficult task to perform due to the size thereof and the turbulence generated by the rotation of the elements thereabove. Efforts have been made to eliminate dust and lint in such an area which, at the outset amounted to manual, periodic shoveling or scraping of accumulated lint from beneath the machine by workers. Subsequently plenums with attached suctions ducts have been installed under the carding elements to capture lint, dust and fly that fall through. Examples of such prior art devices include the British Pat. to David Walsh No. 562,740 in which an undercard cleaning system is provided with a collection tube or suction opening at one end of the chamber and a fan at the other end thereof which blows air currents toward the collection tube. Other examples of undercard cleaning systems are illustrated in the United States Pat. to Schonenberger No. 2,964,804 and to Gunter No. 4,057,877. Both of these patents are illustrative of collection plenums or tubes which are designed to continuously clean the underneath area of the carding machine. A further example of pneumatic cleaning of the chamber beneath the carding elements of a textile machine is illustrated in applicant's co-pending application Ser. No. 961,936 filed Nov. 20, 1978.

While each of these systems is effective to automatically eliminate a considerable portion of the lint, dust and fly beneath the carding machine there remain several unsolved problems which severly limit the efficiency of these vacuum or pneumatic cleaning systems. First of all most undercard floor surfaces are not smooth enough for the waste to be moved across it with gentle air currents. Secondly, there are various areas beneath a carding machine which contain sharp edges or burrs to which pieces of lint attach themselves and grow as time goes by. These pieces of lint are called tags and are caused by rough edges. Further, most carding machines are provided with a cross-girt which is an underneath brace for the frame of a carding machine and which amounts to a hump or protuberance extending transversely across the floor beneath the carding machine at about the midpoint thereof. Lint being blown or sucked from one end to the other encounters this obstruction and accumulates on the upstream side thereof. Such accumulations are very difficult to remove merely by pneumatic means. Also, one of the problems with existing pneumatic means is the many stray currents of air in the area beneath the carding machine caused by cracks or openings. Most carding machines are provided with a frame which has small pedestals or feet beneath the sides. In levelling the card, shims are placed beneath the feet which even increase the size of existing cracks between the floor or surface on which the card is mounted and the lower edge of the frame. Such cracks adversely or deleteriously affect the efficiency of a pneumatic undercard cleaning system.

SUMMARY OF THE PRESENT INVENTION

The present invention on the other hand is directed to a technique for eliminating the above mentioned problems and thus is adaptable for use with several different types of pneumatic undercard cleaning systems. While the invention will be discussed with particular reference to carding machines, there are other textile machines which are involved in fiber preparation such as combers, pickers, and openers which generate waste in the area below the machine which needs to be pneumatically collected and with which the present invention would be useful.

In general, it is the purpose of the present invention to provide a smooth floor construction which also includes a means for filling or sealing up the cracks which exist between the frame and support surface of such machines, as well as covering over and eliminating any burrs or accumulation areas for the lint to form during the pneumatic conveyance of the lint across the floor beneath the machine. To accomplish this purpose, a grout-like material is poured or floated into the cavity beneath the machine to a height sufficient in depth to be greater than the greatest of the cracks existing between the frame and the support surface. Also, in instances where a cross-girt is used the grout material is provided to the underneath side of the machine to a depth greater than the height of the girt.

The aforementioned grout may be any of several different types; however, it has been found that Embeco® 636 Grout, a non-shrink, flowable grout manufactured and sold by Master Builders of Cleveland, Ohio, makes an excellent material and has good flow characteristics in the uncured state, bonds well to the adjoining surfaces, and sets up or cures with a satisfactorily level and smooth surface. To achieve even further smoothness of the surface of the grout it is also contemplated and within the scope of this invention to provide an upper layer or coating of a urethane or acrylic liquid material, such as that which is applied to floors. Such a finish provides a very slick and excellent surface which will ensure good movement of lint and dust across the surface thereof responsive to the pneumatic collection equipment.

It is recognized that, where a cross-girt is utilized on machines, sometimes the grout material might have to be applied to a thickness of three or four inches. This could be quite expensive and therefore in such situations it is contemplated that a filler material such as Styrofoam blocks or the like might be utilized to occupy a significant portion of the space. The grout would then be poured around and over the filler blocks, so that the amount of more expensive grout may be minimized. Several advantages to such a smooth floor construction for the chamber beneath the carding machine immediately come to mind. This expedient provides a smooth surface for either wood or concrete floors, it eliminates the gap between the card "feet" and the floor and gaps between the card base and the floor, as well as eliminating the girt as an obstruction to lint removal. Further, other more subtle advantages result from this type of floor construction which include a reduced area between the main cylinder and/or main cylinder screen and the floor resulting in a higher velocity of air through the undercard chamber thereby reducing the air quantity required for undercard cleaning. Also, many of the impossible to eliminate "lint-catching" areas in the undercard cavity are covered. The effective height of the floor is also raised whereby a better and more direct air flow pattern through the doffer end door to the undercard cleaning suction plenum at the other end of the carding machine is provided.

It is therefore an object of the present invention to provide an improved smooth floor construction for the cavity or chamber beneath conventional cards.

It is another object of the present invention to provide an improved floor construction of the type described in which many of the "lint-catching" areas in the undercard cavity are eliminated.

Another object of the present invention is to provide a floor construction which eliminates the cross-girt as an obstruction to lint removal without eliminating the girt itself.

Still another object of the present invention is to provide an undercard floor construction which eliminates cracks or gaps between the card feet and the floor as well as between the card base and the floor.

These and other objects will become more apparent after reading the following detailed description of a preferred embodiment along with the accompanying drawings in which:

FIG. 1 is a longitudinal sectional view of a conventional carding machine having the frame thereof shimmed in order to level the machine, and being illustrative of the cracks and gaps which are formed as a result of such shimming and levelling process; and FIG. 2 is a sectional view similar to FIG. 1 except showing the addition of the grout in accordance with the present invention to fill the gaps and cracks.

DETAILED DESCRIPTION OF PREFERRED EMBODIMENT

Figure 1:
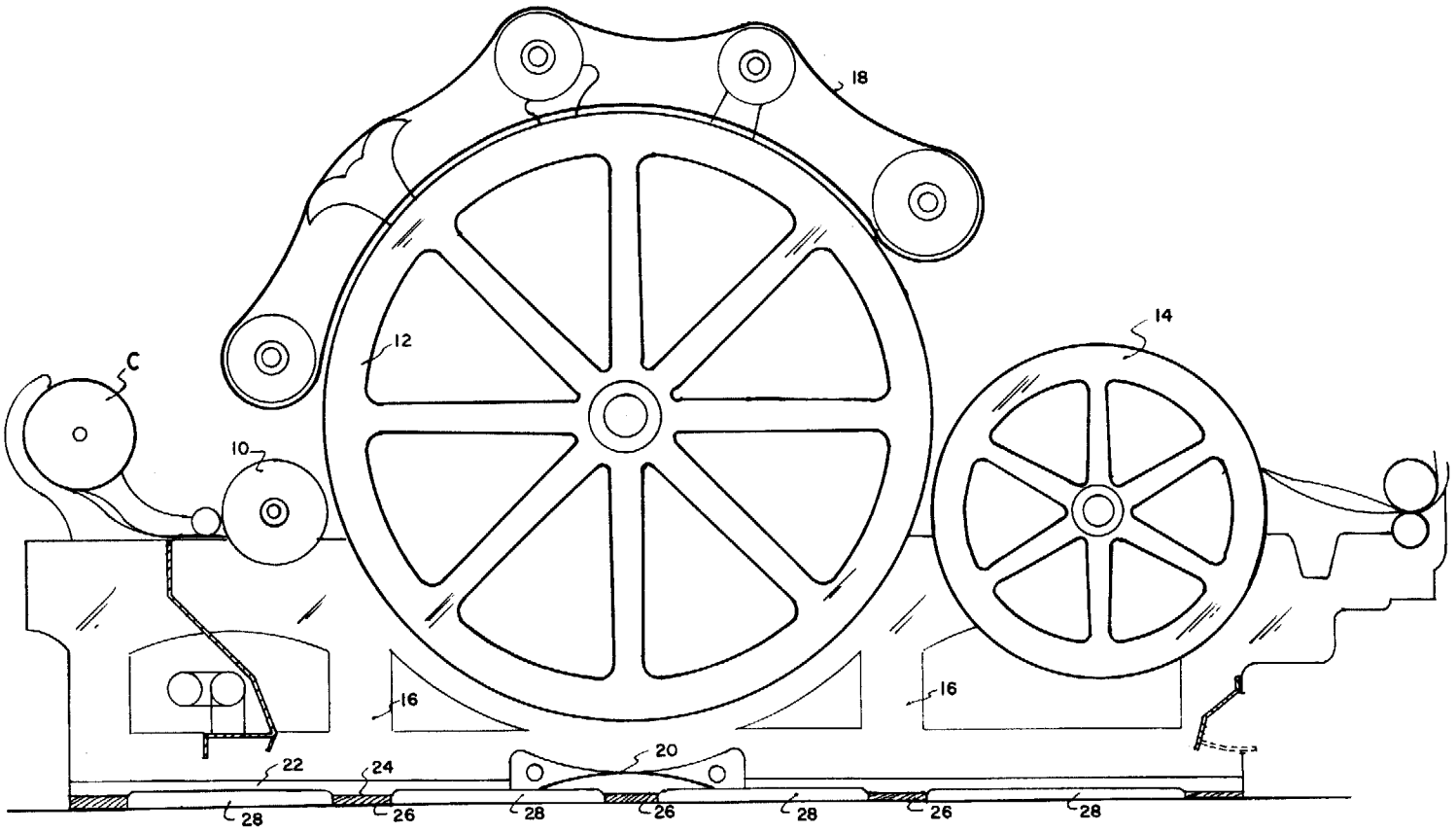

Turning now to FIG. 1, there is illustrated a carding machine of the type in which a lickerin 10, a main cylinder 12, and a doffer 14 are mounted on a frame 16. A set of working flats 18 is mounted above the main cylinder 12 and raw cotton C is passed from a feed roll through the carding machine to form sliver in a conventional, known manner. The carding process, being well known, will not be discussed further herein other than to mention that during the forming of sliver by the carding elements 10, 12, 14 and 18, considerable lint, dust and fly all of which will hereinafter be collectively referred to as "waste", is generated and works its way into the chamber formed by frame 16 beneath the carding element 10, 12 and 14, as well as into the atmosphere above the carding machine. Various types of waste collection equipment are known for collecting waste from the area above the carding elements.

Further, some systems have been developed which pneumatically collect waste from the area beneath the carding machine 16. Examples of such systems are described in the aforementioned British Pat. to Walsh No. 562,740; the U.S. Pat. to Gunter No. 4,057,877; and applicant's co-pending previously filed application Ser. No. 961,936, filed Nov. 20, 1978. In each of these systems an air path or current is moved through the area beneath the carding machine carrying with it lint and dust which would otherwise collect on the floor, thus achieving a "sweeping action" of the lint and dust across the floor area. However, certain problems arise as a result of conditions beneath the machine which prevent or block the free flow of lint from one end of the machine to the other. For example, most carding machines have a cross-girt 20 which extends between opposed bottom rails 22 of the frame sides 16. This girt 20 provides a protuberance or hump in the floor F, which prohibits the free flow of lint from one end of the machine to the other. Also, the aforementioned bottom rails 22 of most cards are provided with a plurality of feet 24 on which the rails rest. There will thus naturally occur a slight gap or crack between adjacent feet 24. Further since most carding machines need to be leveled, the addition of shims 26 at points along the length of the carding machine will even increase the size of the gaps or cracks 28. These cracks 28, as well as the additional distance between the bottom of the main carding cylinder 12 and the floor F increase substantially the air quantity necessary to pull air from one end of the machine to the other. It is difficult to provide either a wooden or concrete floor with a perfectly smooth surface which will not have bumps or ridges therein which tend to collect pieces of lint which subsequently grow into tags. Further, the adjacent sides of the carding machines will have burrs or rough places which will tend to cause lint to collect.

One known attempt to correct the problem created by the girt 20 which extends from side to side of the frame 16 is the addition of a sheet metal false floor. Besides being expensive and heavy, the sheet metal cannot possibly make a good seal against the sides of the frame 16 since there are various protuberances, nuts, bolts, flanges, and the like which prevent a good seal against the side, and therefore the gaps or cracks 28 are merely moved to another location.

Figure 2:
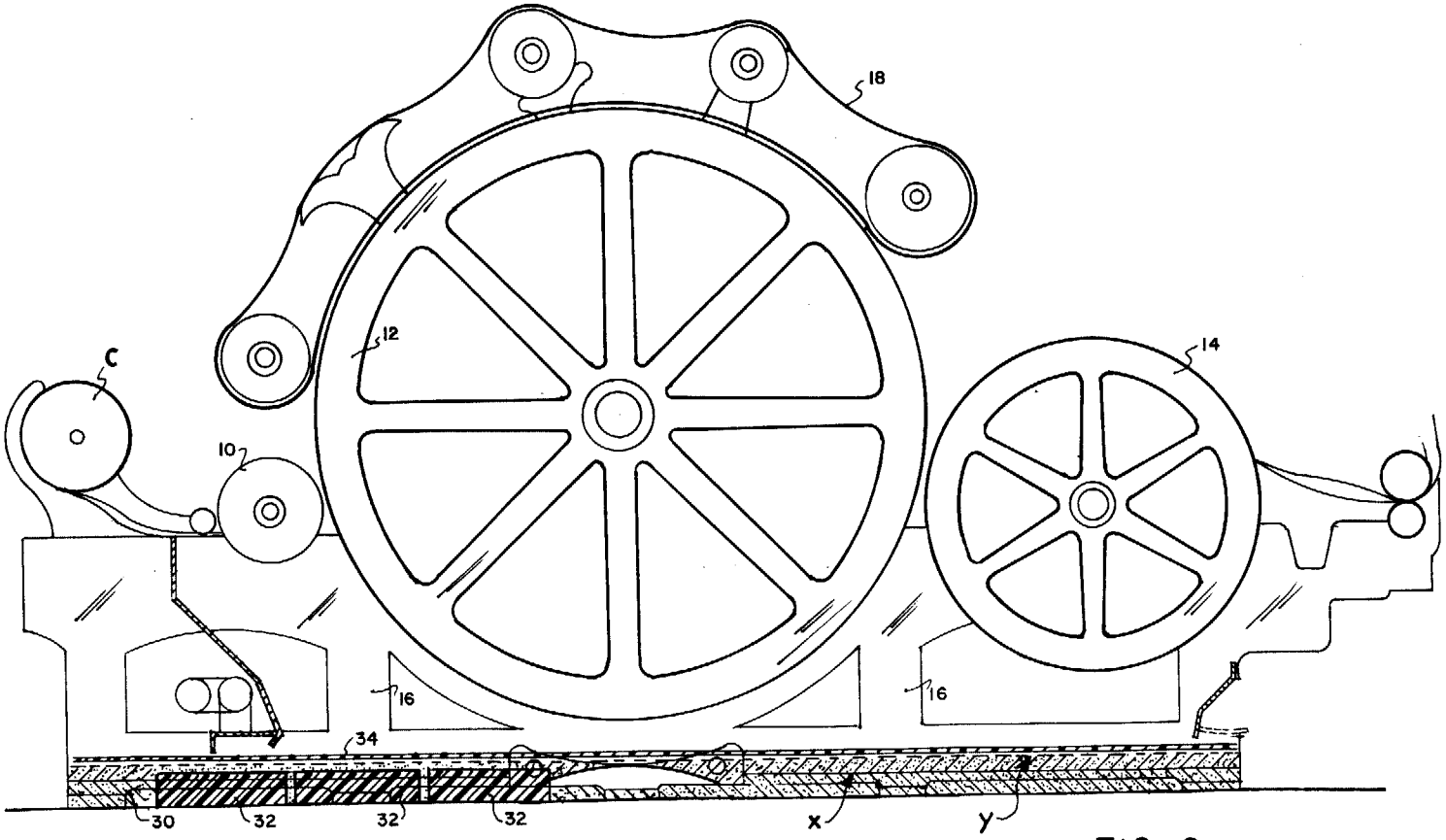

The present invention, as illustrated in FIG. 2 solves this problem by the addition of a grout-like material 30, which is introduced into the cavity beneath the carding machine in a liquid or free-flowing state. Although various types of grout would prove to be satisfactory for this operation it has been found that Embeco ® 636 Grout, a product of Master Builders of Cleveland, Ohio, is preferred because of its free flowing characteristics when uncured, its tendency to adhere well to the wooden, concrete or metal surfaces with which it is likely to come into contact, and its ability to form a smooth upper surface when cooled and hardened. Also, there is little if any shrinkage which occurs after the material is cured. While it is believed that the grout 30 will form a satisfactory surface alone, substantially free of lint catching burrs, cracks, and the like, it is contemplated that within the scope of the preferred features of this invention to provide a smooth, slick coating 34 of urethane, acrylic or a similar shellac, lacquer or wax finish. Besides providing a smoother, slicker surface, the urethane or acrylic coating 34 will fill any cracks, crevices, burrs, or the like as well as ensuring good adherence of the grout material to the side walls. The urethane or acrylic coating may even be applied up a short distance onto the sides of the frame 16 to ensure sealing of the edges of the grout material to the frame.

In situations where no girt is used beneath the carding machine or where the girt may be removed, it is contemplated that a relatively shallow layer of grout 30 may be applied up to a first line X in FIG. 2 which is merely sufficient to cover the gaps 28 formed beneath the rails 22 of the frame and the surface on which the carding machine rests. However, where the girt 20 is utilized and it is not desired to be removed for one reason or another, in order that the amount of grout 30 may be minimized, it is contemplated that blocks 32 of a filler material such as Styrofoam be utilized. Such blocks 32 are placed on the surface F upon which the carding machine rests, then the grout material 30 is poured over and around the blocks up to the imaginary line Y which is substantially level with or slightly above the top of the girt. Use of such blocks 32 substantially minimizes the amount of the more expensive grout material which must be used when significant depths are necessary.

It can be easily seen from FIG. 2 that the floor construction not only provides a very smooth, unobstructed surface across which waste will easily be swept, it also considerably reduces the volume of the cavity and decreases the distance between the floor level and the main cylinder 12. Therefore, the same air quantity applied to suction equipment such as that described in applicant's co-pending application Ser. No. 961,936 will provide a greater current of air beneath the machine or the same current of air may be provided with a leasser air quantity, thus leading to improved efficiency.

While a preferred embodiment has been described in detail hereinabove, it is apparent that changes and modifications might be made to the preferred embodiment without departing from the scope of the invention which is set forth in the claims below.

What is claimed is:

1. In a fiber processing textile machine of the type having fiber processing elements mounted on a frame, walls substantially covering the sides and ends of the frame between the top of the frame and the floor forming a chamber thereunder, a smooth chamber floor construction comprising a grout-like material having the characteristics of being substantially liquid when applied so that it flows to a smooth level upper surface, then cures to form a solid material, said grout material covering the area of the chamber between the end walls and the side walls and being of such a thickness as to cover and seal any existing cracks between the bottom of the frame and the surface on which the machine rests.

2. The floor construction according to claim 1 wherein said textile machine includes a cross-girt thereunder and the thickness of the grout material is such as to provide a level at least equal to the top of the cross-girt.

3. The floor construction according to claim 1 and further including a coating comprising a material selected from the group containing urethane and acrylic finishes, said coating applied over the entire upper surface of the grout material.

4. The floor construction according to claim 1 and further including a plurality of blocks of foam material used as fillers between the surface upon which the textile machine rests and the upper level of the grout material.

5. A method of providing a smooth floor construction free of lint catching areas for the chamber beneath a carding machine of the type having carding elements including lickerin, main cylinder, and doffer operatively mounted on a frame, and walls substantially covering the sides and ends of the frame between the top of the frame and the floor forming said chamber, said method comprising the steps of introducing a sufficient amount of a substantially liquid grout-like material to generate a depth greater than the height of any cracks existing between the bottom of said frame and the surface on which it rests and levelling the upper surface of said grout material to a desired surface smoothness.

6. The method according to claim 1 wherein a coating selected from the group containing urethane and acrylic finishes is applied across the surface of the grout-like material.

7. In a machine of the type having a pneumatic cleaning system including a fan and/or suction equipment for removal of lint and debris from underneath the machine, and said machine being of the type having elements mounted on a frame and walls substantially covering the sides and ends of the frame between the top of the frame and the floor forming a chamber thereunder, an improved chamber floor construction, said improvement comprising: a grout like material having the characteristics of being substantially liquid when applied so that it flows to a smooth level upper surface, then cures to form a solid material, said grout material covering the area of the chamber between the end walls and the side walls and being of such a thickness as to cover and seal any existing cracks between the bottom of the frame and the surface on which the machine rests.

* * * * *